United States Patent [19]

Hutchinson

[11] Patent Number: 5,021,619

[45] Date of Patent: Jun. 4, 1991

[54] FLOW RESPONSIVE SWITCH APPARATUS

[75] Inventor: Harold D. Hutchinson, Malibu, Calif.

[73] Assignee: Harwil Corporation, Santa Monica, Calif.

[21] Appl. No.: 502,811

[22] Filed: Apr. 2, 1990

[51] Int. Cl.[5] ..... H01H 35/40

[52] U.S. Cl. ..... 200/81.9 M; 73/861.74; 340/610

[58] Field of Search ..... 340/606, 610; 335/205-207; 73/189, 861.74, 861.75, 861.76; 200/81.9 R, 81.9 M; 307/118

[56] References Cited

U.S. PATENT DOCUMENTS

| | | | |
|---|---|---|---|
| 2,421,768 | 6/1947 | Voliazzo | 340/610 |
| 4,034,174 | 7/1977 | McCord | 73/861.76 |
| 4,074,097 | 2/1978 | Hutchinson | 200/81.9 R |
| 4,152,688 | 5/1979 | Dietz | 200/81.9 M |
| 4,282,413 | 8/1981 | Simons | 200/81.9 M |
| 4,788,534 | 11/1988 | Engelhardt | 200/81.9 M |
| 4,827,092 | 5/1989 | Kobold | 340/610 |

*Primary Examiner*—Gerald P. Tolin
*Attorney, Agent, or Firm*—William W. Haefliger

[57] ABSTRACT

A liquid flow switch apparatus is provided for connection to ducting wherein liquid flows forwardly. The apparatus comprises: a support body connectible to the ducting; a stem carried by the body to project into a liquid flow zone in the ducting, and a magnetically responsive switch in the stem; a cantilevered arm carried by the body to project into the flow zone upstream of the stem and to be deflected downstream into supported relation with the stem in response to flow impingement on the arm; and a magnet carried by the arm to be displaced by the stem deflection into sufficiently close proximity with the stem and the switch as to effect switch operation.

11 Claims, 3 Drawing Sheets

FLOW RESPONSIVE SWITCH APPARATUS

BACKGROUND OF THE INVENTION

This invention relates generally to flow responsive switch apparatus, and more particularly to improved apparatus of this type wherein the flow responsive arm is supported to minimize fatigue failure.

In prior flow switch devices, a cantilevered arm was deflected in bending by the flow into unsupported position in the flow stream, whereby the arm was then subject to back and forth bending in the flow stream in response to varied flow conditions such as turbulence. This often led to early fatigue failure of the arm, and required frequent arm replacement.

Accordingly, there is need for an improved device not subject to such early fatigue problems. There is also need for improved flow switch apparatus which is very simple, easily downsized, highly reliable, and which can be installed and operated in pipes or ducts extending at different angles.

SUMMARY OF THE INVENTION

It is a major object of the invention to provide an improved fluid flow responsive switch which meets the above needs. As will be seen, the apparatus of the invention is installable into ducting or piping wherein fluid, such as liquid, flows forwardly, the apparatus comprising:

a) a support body connectible to said ducting, b) a stem carried by the body to project therefrom into a liquid flow zone in the ducting, and magnetically responsive switch means in the stem, c) a cantilevered arm carried by the body to project into said flow zone upstream of said stem and to be deflected downstream into supported relation with the stem in response to flow impingement on the arm, d) and magnetic means carried by the arm to be displaced by said stem deflection into sufficiently close proximity with the stem and said switch means as to effect switch operation. Typically, the arm has a substantially flat surface facing upstream away from the stem to receive direct flow impingement thereagainst; and the arm has a first position spaced from said stem and toward which it is yieldably urged in the absence of said flow, the arm having a second position when flow deflected into said supported relation with the stem.

It is another object of the invention to provide the arm in the form of a flat spring which is yieldably bent in said second position; also, the arm has a supported end in a hollow formed by the body out of the main flow stream, the arm tapering in width away from its supported end, and in the flow stream. Further, the arm has a large lower end extent responsive to the flow, and forming an opening for retention of magnet encapsulating cup parts positioned to be deflected squarely toward and against the switch stem, for switch actuation and arm support, in response to the flow impingement upon the arm.

These and other objects and advantages of the invention, as well as the details of an illustrative embodiment, will be more fully understood from the following specification and drawings, in which:

DRAWING DESCRIPTION

DETAILED DESCRIPTION

Figure 1:
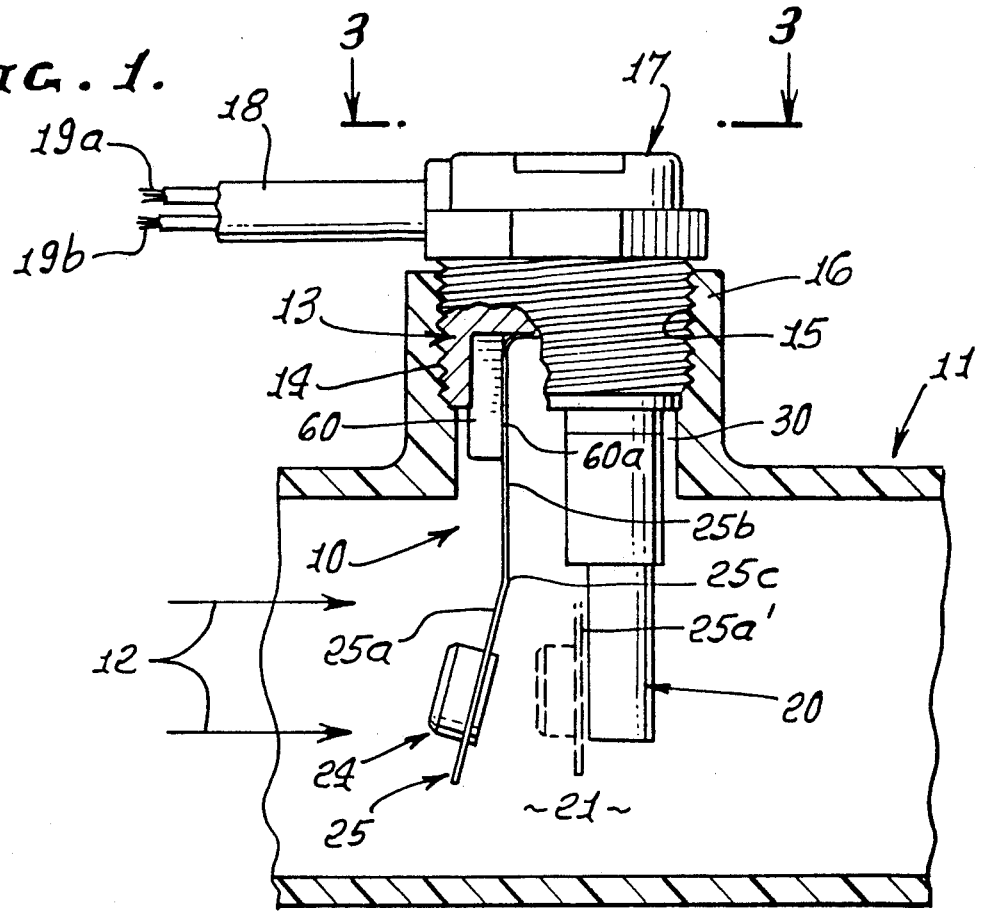
FIG. 1 is a section taken in elevation, showing one form of the invention.

FIG. 1 shows the liquid flow switch apparatus 10 connected into ducting 11 wherein liquid flows forwardly, as indicated by arrows 12. The apparatus 10 includes a support body 13 having exterior threading 14 that is received into interior threading 15 in a hollow tee section 16 of the ducting. The tee and ducting may consist of synthetic resin, as may the support body 13. A cap 17 on the body carries a cable 18 from which electrical wires project at 19*a* and 19*b*.

A stem 20 is carried by the body to project downwardly into a liquid flow zone 21 in the ducting 11, as shown. The stem may be integral with the body 13, and is typically hollow at 20*a* to receive a magnetically responsive switch 22. See FIGS. 2 and 7. The switch may be encapsulated in the stem, as indicated by encapsulating epoxy resin seen at 23 in FIG. 7. The switch extends close to frontward facing wall 20*b* of the stem for magnetic actuation by a permanent magnet 23 in an encapsulating structure 24.

Figure 2:
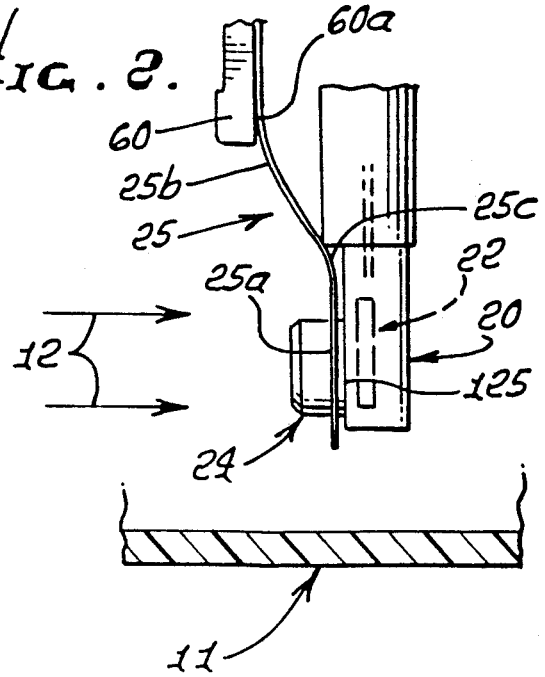
FIG. 2 is a fragmentary view showing a portion of the stem, cantilevered arm, and magnetic means as the arm, deflected by water flow into switch actuating position.
Figure 3:
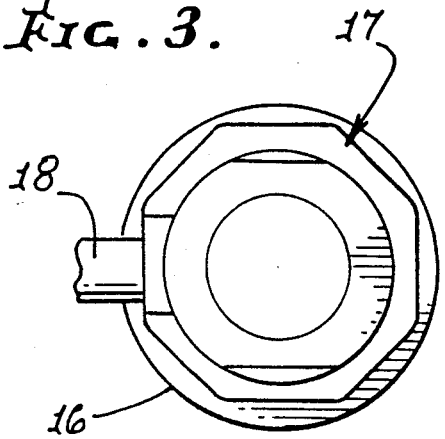
FIG. 3 is a top plan view taken on lines 3—3 of FIG. 1.

A cantilevered arm 25 is also carried by the body 13 to project downwardly into the flow zone 21, but upstream of the stem 20. See the flow direction arrows 12, in FIG. 1. The arm is supported to be deflected downstream into supported relation with the stem in response to flow impingement upon arm extent projecting into the flow zone. The arm has a flat, enlarged lower portion 25*a* facing the flow, for quick response to the flow, and an upper portion 25*b* that tapers toward portion 25*a* for aiding bending deflection into the position as seen in FIG. 2. Such taper also minimizes bending stress. Note also that the arm is bent at 25*c* between portions 25*a* and 25*b*, so that arm portion 25*a* squarely approaches the stem as seen at 25*a*' in FIG. 1. This facilitates square approach of structure 24, i.e. to flatly engage the stem, at 125 seen in FIG. 2.

Figure 6:
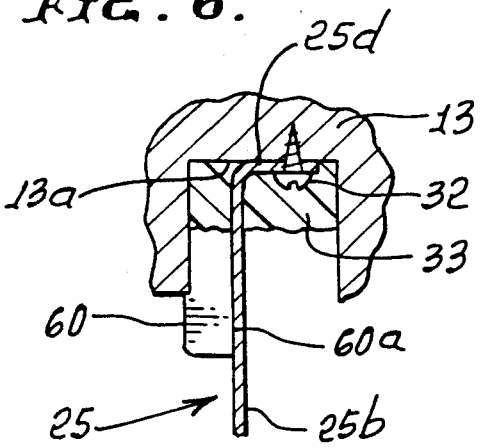
FIG. 6 is a fragmentary section taken in elevation, showing mounting of one end of the cantilevered arm.

The uppermost extent 25*d* of the metallic arm 25 is fixedly supported by the body 13, as within a hollow 30, above the flow zone, and within tee section 16. FIG. 6 shows one highly advantageous method of attaching the arm to interior wall 16*a* of the tee section. As seen, the arm portion 25*d* is bent approximately 90°, and retained flatly against wall 16*a*, as by a fastener or fasteners 32 and/or by potting resin 33, such as epoxide, filled into hollow 30 to the depth shown. This establishes vertical support for the arm upper portion 25*b*, such to facilitate arm bending to the position as seen at 25' in FIGS. 2.

It is an important feature that, with the structure 24 engaging the stem, the arm is held in fixed position by flow impingement on the arm, minimizing arm oscillation that could otherwise lead to early fatigue failure.

Figure 4:
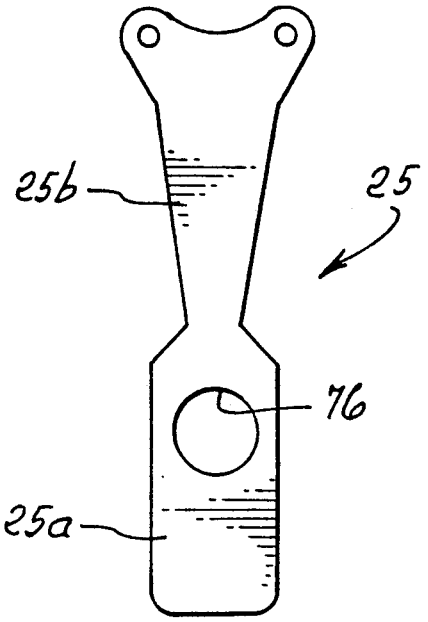
FIG. 4 is a plan view of a cantilevered arm.
Figure 5:
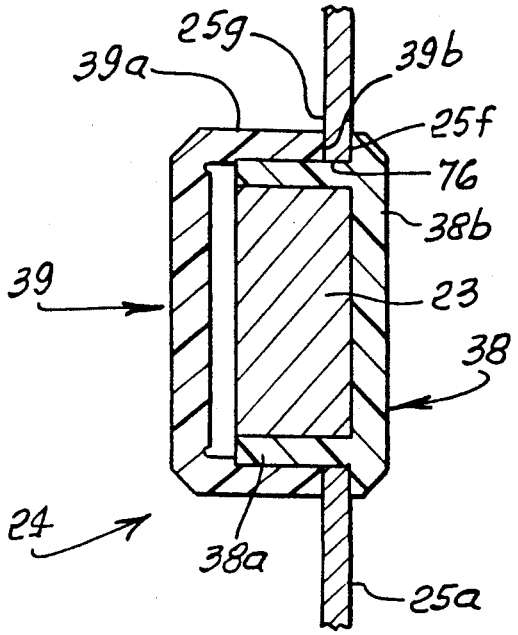
FIG. 5 is an enlarged section, showing arm support of a magnet and magnet holder.

FIGS. 4 and 5 illustrate the provision of an opening 76 in the arm lower portion 25*a*, for reception of skirt 38*a* of a plastic cup 38, the cup head 38*b* engaging the side 25*f* of the arm. A second plastic cup 39 has a skirt 39*a* that telescopically interfits skirt 38*a*; also rim 39*b* of the skirt 39*a* engages the side 25*g* of the arm, to position the two cup elements for reception and retention of a permanent magnet 23 therein, as shown. When bonded together, the two skirts firmly hold the structure 24 to the arm, with the magnet positioned therein, for actuation of the switch.

Figure 7:
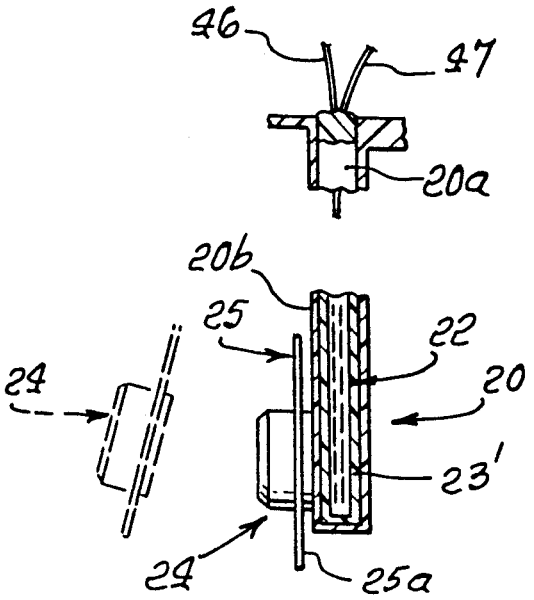
FIG. 7 is a section showing a reed switch in the stem, and its proximity to the magnet, in arm deflected position.

FIG. 7 shows the switch 22 in the form of a "reed" switch, to be actuated by the magnet wherein the structure 24 is in full line position as shown. Switch wires 46 and 47 extend upwardly within the stem for suitable connection with the ends of wires 18 and 19, within cap 17.

If desired, the apparatus may be rotated so as to extend at about 90° to the position shown, whereby stem 20 and arm 25 then extend generally horizontally. Also, the device may be inverted, and may be used in pipes extending at various angles.

The simplicity of the device, as described, permits small size and low profile application.

Figure 8:
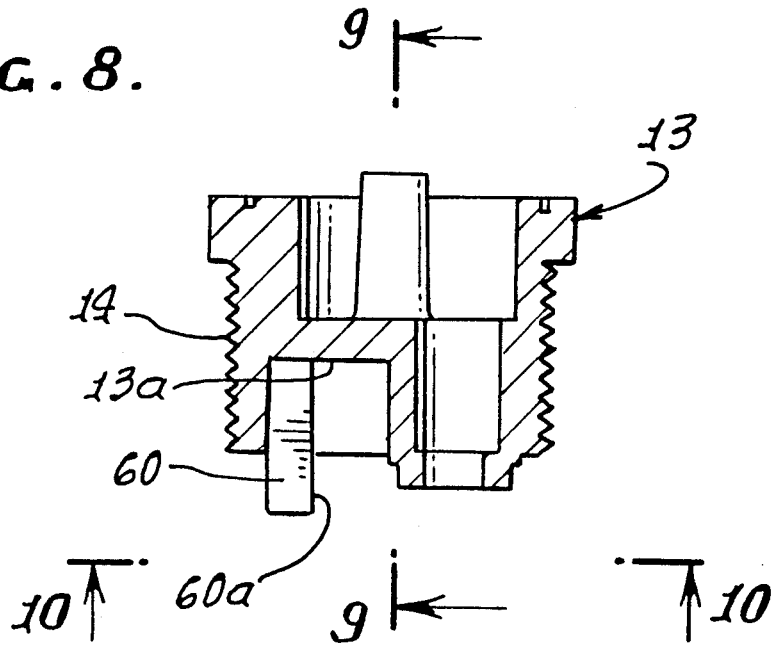
FIGS. 8, 9 and 10 are views that show the construction of the upper portion of the arm and stem supporting body.
Figure 9:
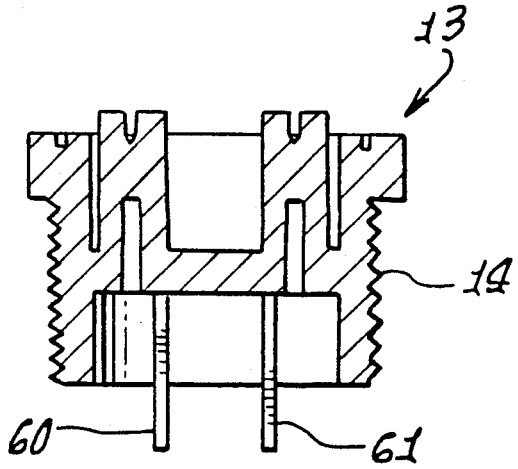
Figure 10:
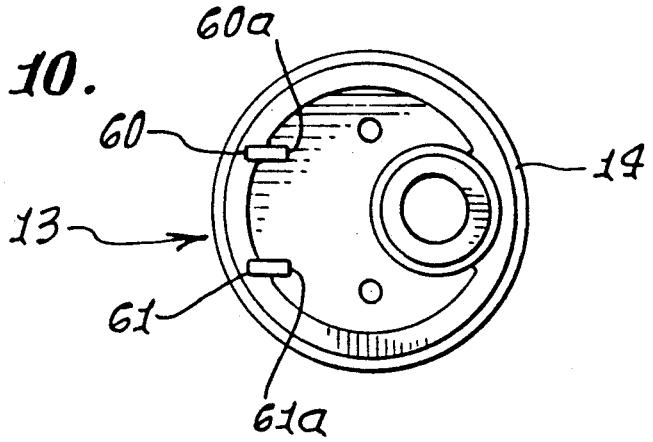

Note in FIGS. 1, 8 and 10, the provision of two support arms 60 and 61 integral with body 13, and projecting downwardly. They provide stop shoulders 60*a* and 61*a* to be positively or forcibly engaged by the arm upper extent 25*b* in the hollow 30, in the absence of flow, due to the spring characteristics of the flat spring arm. Thus, the arm is normally in one or the other of two stable positions (engaging 60 and 61 in arm "relaxed" position, and engaging the stem 20 in flow deflected arm position) to minimize arm bending, and optimize fatigue strength.

The switch apparatus is useful in flow streams consisting of either liquid or gas. Also, the body, and/or stem, and/or ducting may consist of plastic or metal, or other suitable material.

I claim:

1. In liquid flow switch apparatus connected to ducting wherein liquid flows forwardly, the combination comprising a) a support body connectible to said ducting, b) a stem rigidly carried by the body and projecting therefrom into a liquid flow zone in the ducting, and magnetically responsive switch means in the stem, c) a thin cantilevered arm fixedly carried by the body and projecting into said flow zone upstream of said stem and deflectable downstream into direct contact with the stem in response to flow impingement on the arm, d) and magnetic means carried by the arm to be displaced by said stem deflection into sufficiently close proximity with the stem and said switch means as to effect switch operation, e) said arm itself being yieldably flexible to provide the only spring force acting to resist arm deflection, and f) the body supporting a stop shoulder limiting movement of the arm away from the stem, at an arm first position toward which it is yieldably urged in the absence of said flow.

2. The combination of claim 1 wherein said arm has a substantially flat surface facing upstream away from the stem to receive direct flow impingement thereagainst.

3. The combination of claim 1 wherein the body and stem are unitary and consist of molded plastic material.

4. The combination of claim 1 wherein the body is hollow and the arm has a supported end in the body hollow, the arm tapering in width away from said supported end.

5. The combination of claim 4 wherein said arm supported end forms a bend, and including potting resin encapsulating said bend in said hollow.

6. The combination of claim 4 wherein said arm-supported end forms a bend, and including fastener means attaching said bend to said body, interiorly of the body.

7. The combination of claim 1 wherein the arm is metallic and comprises a flat spring which is yieldably bent in said second position.

8. The combination of claim 1 wherein said switch means comprises a reed switch.

9. The combination of claim 1 wherein the arm comprises a thin metallic member forming a through opening, and including molded plastic cup parts encapsulating said magnetic means and retained by the arm, at least one of said parts extending through said opening.

10. The combination of claim 1 wherein said stop shoulder is defined by two narrow members projecting downwardly in a hollow defined by the support body, and against which the arm, in the form of a flat spring, forcibly seats, in the absence of flow.

11. The combination of claim 1 wherein said ducting has a hollow tee to which the body is connected.

* * * * *